United States Patent [19]

Borsenberger

[11] Patent Number: 4,619,877

[45] Date of Patent: Oct. 28, 1986

[54] LOW FIELD ELECTROPHOTOGRAPHIC PROCESS

[75] Inventor: Paul M. Borsenberger, Hilton, N.Y.

[73] Assignee: Eastman Kodak Company, Rochester, N.Y.

[21] Appl. No.: 804,337

[22] Filed: Dec. 5, 1985

Related U.S. Application Data

[63] Continuation of Ser. No. 642,603, Aug. 20, 1984, abandoned.

[51] Int. Cl.[4] ..... G03G 13/22

[52] U.S. Cl. ..... 430/31; 430/57; 430/902

[58] Field of Search ..... 430/31, 57, 902

[56] References Cited

U.S. PATENT DOCUMENTS

| | | | |
|---|---|---|---|
| 4,225,222 | 9/1980 | Kempter | 355/3 DR |
| 4,265,991 | 5/1981 | Hirai et al. | 430/64 |
| 4,359,512 | 11/1982 | Fukuda et al. | 430/57 |
| 4,359,514 | 11/1982 | Shimizu et al. | 430/65 |
| 4,377,628 | 3/1983 | Ishioka et al. | 430/57 |
| 4,391,033 | 7/1983 | Shinozaki | 156/657 X |
| 4,391,889 | 7/1983 | Mabuchi et al. | 430/80 X |
| 4,393,348 | 7/1983 | Goldstein et al. | 324/158 R |
| 4,403,026 | 9/1983 | Shimizu et al. | 430/65 |
| 4,409,308 | 10/1983 | Shimizu et al. | 430/60 |
| 4,443,529 | 4/1984 | Kanbe et al. | 430/65 |
| 4,452,874 | 6/1984 | Ogawa et al. | 430/57 |
| 4,452,875 | 6/1984 | Ogawa et al. | 430/57 |
| 4,465,750 | 8/1984 | Ogawa et al. | 430/57 |
| 4,466,380 | 8/1984 | Jansen | 118/723 X |
| 4,484,809 | 11/1984 | Coleman | 430/95 X |

FOREIGN PATENT DOCUMENTS

| | | |
|---|---|---|
| 2018446 | 3/1979 | United Kingdom . |

*Primary Examiner*—Roland E. Martin

*Attorney, Agent, or Firm*—Alfred P. Lorenzo

[57] ABSTRACT

An electrophotographic process in which a photoconductive insulating element, comprising a layer of intrinsic hydrogenated amorphous silicon in electrical contact with a layer of doped hydrogenated amorphous silicon, is electrostatically charged to a low level of surface voltage, such as, for example, a level of ten volts, provides an advantageous combination of very high electrophotographic sensitivity with minimal electrical noise.

13 Claims, 2 Drawing Figures

LOW FIELD ELECTROPHOTOGRAPHIC PROCESS

This is a continuation of application Ser. No. 642,603, filed Aug. 20, 1984, now abandoned.

FIELD OF THE INVENTION

This invention relates in general to electrophotography and in particular to a novel low field electrophotographic process. More specifically, this invention relates to a low field electrophotographic process employing a photoconductive insulating element which exhibits high quantum efficiency at low voltage.

BACKGROUND OF THE INVENTION

Photoconductive elements comprise a conducting support bearing a layer of a photoconductive material which is insulating in the dark but which becomes conductive upon exposure to radiation. A common technique for forming images with such elements is to uniformly electrostatically charge the surface of the element and then imagewise expose it to radiation. In areas where the photoconductive layer is irradiated, mobile charge carriers are generated which migrate to the surface of the element and there dissipate the surface charge. This leaves behind a charge pattern in nonirradiated areas, referred to as a latent electrostatic image. This latent electrostatic image can then be developed, either on the surface on which it is formed, or on another surface to which it has been transferred, by application of a liquid or dry developer composition which contains electroscopic marking particles. These particles are selectively attracted to and deposit in the charged areas or are repelled by the charged areas and selectively deposited in the uncharged areas. The pattern of marking particles can be fixed to the surface on which they are deposited or they can be transferred to another surface and fixed there.

Photoconductive elements can comprise a single active layer, containing the photoconductive material, or they can comprise multiple active layers. Elements with multiple active layers (sometimes referred to as multiactive elements) have at least one charge-generating layer and at least one charge-transport layer. The charge-generating layer responds to radiation by generating mobile charge carriers and the charge-transport layer facilitates migration of the charge carriers to the surface of the element, where they dissipate the uniform electrostatic charge in light-struck areas and form the latent electrostatic image.

The photoreceptor properties that determine the radiation necessary to form the latent image are the quantum efficiency, the thickness, the dielectric constant, and the existence of trapping. In the simplest case, where trapping can be neglected, the exposure can be expressed as:

$$E = \frac{\epsilon k}{Le\lambda}\left(\frac{\Delta V}{\phi}\right)$$

where E is the exposure in ergs/cm$^2$, $\epsilon$ the relative dielectric constant, L the thickness in cm, e the electronic charge in esu, $\lambda$ the wavelength in nm, $\phi$ the quantum efficiency, k a constant equal to $5.2\times10^{-13}$, and $\Delta V$ the voltage difference between the image and background area, $V_i - V_b$. The quantum efficiency, which cannot exceed unity, represents the fraction of incident photons that are absorbed and result in free electron-hole pairs.

For electrophotographic processes known heretofore, $\Delta V$ is typically 400–500 V. Assuming typical values of $\epsilon=3.0$, $\lambda=500$ nm, and $L=10^{-3}$ cm, the above equation predicts an exposure energy of 11.8 to 14.7 ergs/cm$^2$. This assumes that there is no trapping and is based on the absorbed radiation. In practice, the radiation is not completely absorbed, and the exposure is correspondingly larger. Thus, most photoreceptors require exposures in the range of 20–100 ergs/cm$^2$ to form an electrostatic image. These are equivalent to ASA ratings between 0.1 and 0.02. In contrast, the exposure required to form a latent image in conventional silver halide photography is in the range of $10^{-2}$ to $10^{-1}$ ergs/cm$^2$, or less, and, accordingly, the radiation sensitivity of electrophotography is less than that of conventional silver halide photography by a factor of at least $10^3$.

While increases in electrophotographic sensitivity can be realized by increases in thickness or quantum efficiency, these effects are limited. Increases in photoreceptor thickness tend to result in trapping, which gives rise to a sharp decrease in sensitivity. Since the quantum efficiency cannot exceed unity, increases in efficiency are limited. For the example discussed in the preceeding paragraph, the maximum increase in sensitivity would be a factor of about 5. In practice, absorption and reflection losses, photogeneration efficiencies of less than unity, etc., would limit the increase to probably no more than a factor of about 3. Consequently, if the sensitivity is to be significantly increased, the magnitude of the voltage difference between the image and background areas must be reduced. Moreover, if the sensitivity is to be increased without a concurrent increase in electrostatic noise, the magnitude of $V_b$ must also be reduced, since a reduction in $\Delta V$ without a corresponding reduction in $V_b$ results in a very low signal to noise (S/N) ratio.

A reduction in both $\Delta V$ and $V_b$ requires that the photoreceptor be initially charged to very low voltages, e.g., $V_o=10$ volts. However, with photoconductive elements of both the single-active-layer and multiple-active layer types, the quantum efficiency typically decreases sharply with decreasing voltage. [See D. M. Pai and R. C. Enck, Phys. Rev. 11, 5163, (1975); P. J. Melz, J. Chem. Phys 57, 1694, (1972); and P. M. Borsenberger and D. C. Hoesterey, J. Appl. Phys 51, 4248 (1980)]. As a result, electrophotographic processes typically employ a high initial voltage, such as 500 volts, and electrostatic latent image formation typically requires exposures of the order of 20 to 100 ergs/cm$^2$.

It is toward the objective of providing a high speed electrophotographic process which exhibits minimal electrical noise, and, in particular, a low field process employing a very low initial voltage, such as a voltage of 10 volts, that the present invention is directed.

SUMMARY OF THE INVENTION

The electrophotographic process of this invention comprises the steps of:

(1) providing a photoconductive insulating element comprising:

(a) an electrically-conductive support, (b) a barrier layer overlying the support, and (c) a photoconductive stratum overlying the barrier layer which comprises a layer of intrinsic hydrogenated amorphous silicon in electrical contact with a layer of doped hydrogenated amorphous silicon and in which the doped layer is very thin in relation to the thickness of the intrinsic layer;

(2) uniformly electrostatically charging the element to a surface voltage in the range of from 5 to 50 volts, and (3) image-wise exposing the element to activating radiation to thereby form a latent electrostatic image on the surface thereof.

The term "activating radiation" as used herein is defined as electromagnetic radiation which is capable of generating electron-hole pairs in the photoconductive insulating element upon exposure thereof.

Use of a very low initial voltage in the process of this invention, that is a voltage in the range of 5 to 50 volts, in combination with use of an amorphous silicon element of the particular structure described herein has been unexpectedly found to provide the desired characteristics of very high electrophotographic sensitivity without excessive electrical noise. The low $V_b$ and low $\Delta V$ which characterize the process are rendered feasible by the unique electrophotographic properties of the aforesaid element, which provides high quantum efficiency at low voltage.

DESCRIPTION OF THE PREFERRED EMBODIMENTS

Figure 1:
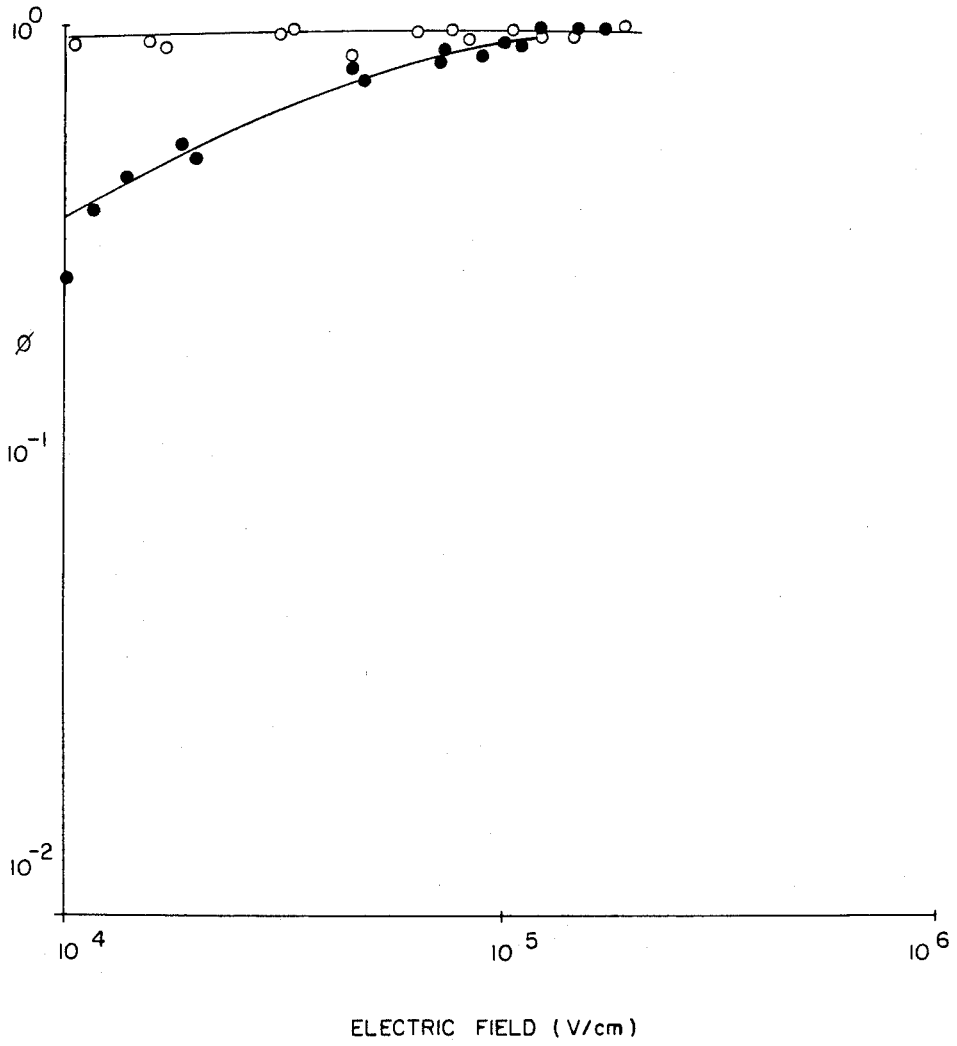
FIG. 1 is a logarithmic plot of quantum efficiency versus electric field for a photoconductive insulating element that is useful in the process of this invention and for a control element.

The preparation of thin films of amorphous silicon, hereinafter referred to as α-Si, by the glow discharge decomposition of silane gas, $SiH_4$, has been known for a number of years. (See, for example, R. C. Chittick, J. H. Alexander and H. F. Sterling, J. Electrochem. Soc., 116, 77, 1969 and R. C. Chittick, J. N-Cryst. Solids, 3, 255, 1970). It is also known that the degree of conductivity and conductivity type of these thin films can be varied by doping with suitable elements in a manner analogous to that observed in crystalline semiconductors. (See, for example, W. E. Spear and P. G. LeComber, Solid State Commun., 17, 1193, 1975). Furthermore, it is widely recognized that the presence of atomic hydrogen plays a major role in the electrical and optical properties of these materials (see, for example, M. H. Brodsky, Thin Solid Films, 50, 57, 1978) and thus there is widespread current interest in the properties and uses of thin films of so-called "hydrogenated amorphous silicon," hereinafter referred to as α-Si(H).

The field of electrophotography is one in which there is extensive current interest in the utilization of thin films of α-Si(H). To date, the art has disclosed a wide variety of photoconductive insulating elements, comprising thin films of intrinsic and/or doped α-Si(H), which are adapted for use in electrophotographic processes. (As used herein, the term "a doped α-Si(H) layer" refers to a layer of hydrogenated amorphous silicon that has been doped with one or more elements to a degree sufficient to render it either n-type or p-type). included among the many patents and published patent applications describing photoconductive insulating elements containing layers of intrinsic and/or doped α-Si(H) are the following:

Misumi et al, U.K. Patent Application No. 2 018 446 A, published Oct. 17, 1979.

Kempter, U.S. Pat. No. 4,225,222, issued Sept. 30, 1980.

Hirai et al, U.S. Pat. No. 4,265,991, issued May 5, 1981.

Fukuda et al, U.S. Pat. No 4,359,512, issued Nov. 16, 1982.

Shimizu et al, U.S. Pat. No. 4,359,514, issued Nov. 16, 1982.

Ishioka et al, U.S. Pat. No. 4,377,628, issued Mar. 22, 1983.

Shimizu et al, U.S. Pat. No. 4,403,026, issued Sept. 6, 1983.

Shimizu et al, U.S. Pat. No. 4,409,308, issued Oct. 11, 1983.

Kanbe et al, U.S. Pat. No. 4,443,529, issued Apr. 17, 1984.

As hereinabove described, the present invention makes use of a particular type of photoconductive insulating element, characterized by the presence of both doped and intrinsic layers of α-Si(H), in an electrophotographic process in which the element is electrostatically charged to a low surface voltage, that is a voltage in the range of from 5 to 50 volts. More specifically, the photoconductive insulating element utilized in the electrophotographic process of this invention comprises:

(a) an electrically-conductive support, by which is meant a support material which is itself electrically conductive or which is comprised of an electrically-insulating material coated with an electrically-conductive layer, (b) a barrier layer overlying the support, by which is meant a layer which serves to prevent the migration of charge-carriers from the support into the photoconductive layers of the element, and (c) a photoconductive stratum overlying the barrier layer which comprises a layer of intrinsic α-Si(H) in electrical contact with a layer of doped α-Si(H) and in which the doped layer is very thin in relation to the thickness of the intrinsic layer.

It is critical to the invention that the photoconductive stratum comprise both an intrinsic α-Si(H) layer and a doped α-Si(H) layer, since use of an intrinsic α-Si(H) layer alone would not be an effective means of generating the necessary charge carriers when employing a low surface voltage; while use of a doped α-Si(H) layer alone would result in too high a dark conductivity for the element to be useful in the low field process of this invention. It is also very important that the doped layer be very much thinner than the intrinsic layer, since, if this were not the case, the dark conductivity would be excessively high for use in the low field process of this invention.

It is also critical to the invention that the element be electrostatically charged to a very low surface voltage, that is a voltage in the range of from 5 to 50 volts. Only by the use of such a low voltage is it possible to achieve very high electrophotographic sensitivity—a sensitivity which is so high that the element can be reasonably characterized as a camera-speed material—without the generation of excessive electrical noise. It is this use of very low voltage which specifically distinguishes the process of this invention from conventional electrophotographic processes which utilize much higher voltages.

Photoconductive insulating elements, whether of the single-active-layer or multiple-active-layer types, typically exhibit a quantum efficiency at low voltage which is much less than they exhibit at high voltage. However, the photoconductive insulating elements described herein exhibit a quantum efficiency at low voltage which is substantially the same as that at high voltage. It is this characteristic which renders them especially suitable for use in the novel low field electrophotographic process of this invention.

The elements employed in the process of this invention utilize an electrically-conductive support, and such support can be either an electrically-conductive material or a composite material comprised of an electrically-insulating substrate coated with one or more conductive layers. The electrically-conductive support should be a relatively rigid material and preferably one that has a thermal expansion coefficient that is fairly close to that of a layer of α-Si(H). Particularly useful materials include aluminum, steel, and glass that has been coated with a suitable conductive coating. Preferably, the support is fabricated in a drum or tube configuration, since such configurations are most appropriate for use with a relatively brittle and fragile material such as α-Si(H).

A particularly important feature of the photoconductive insulating element employed in the process of this invention is the barrier layer. It serves to prevent the injection of charge carriers from the substrate into the photoconductive stratum. Specifically, it prevents the injection of holes from the substrate when the photoreceptor is charged to a negative potential, and it prevents the injection of electrons from the substrate when the photoreceptor is charged to a positive potential. Either positive or negative charging can, of course, be used in the process of this invention, as desired. Inclusion of a barrier layer in the element is necessary in order for the element to provide adequate charge acceptance.

A number of materials are known to be useful to form a barrier layer in an amorphous silicon photoconductive insulating element. For example, useful materials include oxides such as silicon oxide (SiO) or aluminum oxide ($Al_2O_3$). Preferably, the barrier layer is a layer of α-Si(H) which has been heavily doped with a suitable doping agent. The term "heavily doped", as used herein, is intended to mean a concentration of doping agent of at least 100 ppm.

The term "a photoconductive stratum" is used herein to refer to the combination of an intrinsic α-Si(H) layer and a doped α-Si(H) layer in electrical contact therewith. Since the essential requirement is merely that the activating radiation be incident upon the doped layer, the particular order of these layers in the photoconductive stratum is not ordinarily critical. For example, the doped layer can be the outermost layer and the exposure can be from the front side of the element, or the order of the doped and intrinsic layers can be reversed and the exposure can be from the rear side.

The layer of intrinsic α-Si(H) can be formed by processes which are well known in the art. Most commonly, the process employed is a gas phase reaction, known as plasma-induced dissociation, using a silane (for example $SiH_4$) as the starting material. The hydrogen content of the intrinsic α-Si(H) layer can be varied over a broad range to provide particular characteristics as desired. Generally, the hydrogen content is in the range of 1 to 50 percent and preferably in the range of 5 to 25 percent (the content of hydrogen being defined in atomic percentage).

The layer of doped α-Si(H) can be formed in the same manner as the layer of intrinsic α-Si(H), except that one or more doping elements are utilized in the layer-forming process in an amount sufficient to render the layer n-type or p-type. (Doping elements can also be used in the formation of the intrinsic layer since a layer of hydrogenated amorphous silicon, as typically prepared by the plasma-induced dissociation of $SiH_4$, is slightly n-type and a slight degree of p-doping is typically employed to render it intrinsic.) The hydrogen concentration in the doped layer can be in the same general range as in the intrinsic layer.

Many different doping agents are known in the art to be of utility in advantageously modifying the characteristics of a layer of α-Si(H). Included among such doping agents are the elements of Group VA of the Periodic Table, namely N, P, As, Sb and Bi, which provide an n-type layer—that is, one which exhibits a preference for conduction of negative charge carriers (electrons)—and the elements of Group IIIA of the Periodic Table, namely B, Al, Ga, In and Tl, which provide a p-type layer—that is one which exhibits a preference for conduction of positive charge carriers (holes). The preferred doping agent for forming an n-type layer is phosphorus, and it is conveniently utilized in the plasma-induced dissociation in the form of phosphine gas ($PH_3$). The preferred doping agent for forming a p-type layer is boron, and it is conveniently utilized in the plasma-induced dissociation in the form of diborane gas ($B_2H_6$).

The concentration of doping agent employed in forming the doped α-Si(H) layer can be varied over a very broad range. Typically, the doping agent is employed in an amount of up to about 1,000 ppm in the gaseous composition used to form the doped layer, and preferably in an amount of about 15 to about 150 ppm. When a doped α-Si(H) layer is utilized as the barrier layer in the element, it is typically a heavily doped layer, for example, a layer formed from a composition containing 500 to 5,000 ppm of the doping agent.

A particularly advantageous process, for use in forming the doped α-Si(H) layer that is an essential component of the photoconductive insulating element employed in the method of this invention, is the process described in copending United States patent application Ser. No. 642,604 filed Aug. 20, 1984 (issued Sept. 10, 1985 as U.S. Pat. No. 4,540,647), entitled "Method For The Manufacture Of Photoconductive Insulating Elements With A Broad Dynamic Exposure Range," by P. M. Borsenberger. As described in this application, the disclosure of which is incorporated herein by reference, a major improvement in the process of forming a doped α-Si(H) layer by plasma-induced dissociation of a gaseous mixture of a silane and a doping agent is achieved by controlling the temperature of the dissociation process so that an initial major portion of the layer of doped α-Si(H) is formed at a temperature in the range of from 200° C. to 400° C. and a final minor portion of the layer of doped α-Si(H) is formed at a temperature in the range of from 125° C. to 175° C. This improvement in the manufacturing process leads to the important benefit of a greatly extended dynamic exposure range.

The dynamic exposure range is a very important factor in electrophotographic processes. The usual method for evaluating this range is based on a technique employed in conventional photography. This technique involves the following steps:

(1) The surface potential in volts is plotted versus the logarithm of the exposing radiation for a given initial potential, $V_o$, to thereby provide a V-logE curve.

(2) The derivative of the curve is then determined and plotted on the same exposure axis. The derivative is expressed in units of volts/logE and defined as the contrast, $\gamma$.

(3) The dynamic exposure range, in units of logE, is then defined as the ratio of the initial potential, $V_o$, to the maximum contrast, $\gamma_{max}$.

Defined in this manner, the experimental values of the dynamic exposure range very closely approximate the range of optical densities that can be accurately reproduced by the photoreceptor surface potential.

Photoconductive insulating elements comprising a layer of doped $\alpha$-Si(H) exhibit a rather high contrast and thus a rather narrow dynamic exposure range, typically a range of about 0.7 to about 0.8 logE. While values of this magnitude are usually sufficient for the reproduction of digital information (line copy, for example), they are not sufficient for continuous tone reproduction (pictorial information, for example). The invention disclosed in the aforesaid copending patent application is capable of extending the dynamic exposure range to a value of as high as 1.4 logE, or higher, and thus greatly enhances the utility of the resulting element.

In a preferred example of the process of the aforesaid copending patent application, an $\alpha$-Si(H) layer that is doped with boron is prepared by incorporating 15 ppm of diborane gas in the silane gas, and the temperature of the deposition process is controlled so that about eighty percent of the thickness of the doped $\alpha$-Si(H) layer is formed at a temperature of about 250° C. and the remaining twenty percent is formed at a temperature of about 150° C. It is not known with certainty why such process provides the benefit of extended dynamic exposure range. The initial step in plasma-induced dissociation reactions is the transfer of the plasma energy to the gas phase. Provided the plasma energy is sufficiently high, new chemical species are formed that are the intermediate species in the formation of more stable compounds. In the dissociation of $SiH_4$, the intermediate species are believed to be the positive ion fragments SiH, $SiH_2$ and $SiH_3$. Control of the temperature in the aforesaid manner may result in the formation of a "hydrogen profile," that is a variation in hydrogen concentration across the thickness of the layer, or it may alter the relative proportions of intermediate species that are formed and thereby alter the character of the layer that is deposited.

The thickness of the various layers making up the photoconductive insulating elements employed in the process of this invention can be varied widely. The barrier layer will typically have a thickness in the range of from about 0.01 to about 5 microns, and preferably in the range of from about 0.05 to about 1 microns. The intrinsic $\alpha$-Si(H) layer will typically have a thickness in the range of from about 1 to about 50 microns, and preferably in the range of from about 3 to about 30 microns. The doped $\alpha$-Si(H) layer will typically have a thickness in the range of from about 0.01 to about 0.2 microns, and preferably in the range of from about 0.02 to about 0.1 microns.

The doped $\alpha$-Si(H) layer must be sufficiently thin to provide the element with a high degree of dark resistivity, generally a dark resistivity of at least $10^{11}$ ohm-cm, and most typically in the range of to $10^{11}$ to $10^{14}$ ohm-cm. While the exact ratio of the thickness of the doped layer to the thickness of the intrinsic layer is not critical, the doped layer is typically very thin in relation to the thickness of the intrinsic layer. It is preferred that the ratio of the thickness of the doped $\alpha$-Si(H) layer to the thickness of the intrinsic $\alpha$-Si(H) layer be less than 0.01 and particularly preferred that it be in the range of from 0.001 to 0.005.

As previously indicated, the preferred doping agent for forming an n-type layer is phosphorus, and the preferred doping agent for forming a p-type layer is boron. These agents are preferably utilized in the doped layer at a concentration of about 15 to about 150 ppm.

The amount of doping agent utilized needs to be carefully controlled to achieve optimum results. For example, an amount of doping agent which is too low will result in an undesirably low quantum efficiency, while an amount of doping agent that is too great will result in an excessively high dark conductivity.

In addition to the essential layers described hereinabove, the photoconductive insulating elements employed in the process of this invention can contain certain optional layers. For example, they can contain anti-reflection layers to reduce reflection and thereby increase efficiency. Silicon nitride is a particularly useful material for forming an anti-reflection layer, and is advantageously employed at a thickness of about 0.1 to about 0.5 microns.

In the process of this invention, the photoconductive insulating element is electrostatically charged to a surface voltage of 5 to 50 volts, and most preferably of 10 to 20 volts. Charging to this low voltage provides the basis for a very high speed electrophotographic process. The process is also advantageous in that the element has an extremely fast response time, exhibits sensitometry which is essentially temperature independent, and can be readily adapted to provide panchromatic sensitivity through appropriate control of the hydrogen content.

The invention is further illustrated by the following example of its practice.

A photoconductive insulating element was prepared with the following layers arranged in the indicated order:

(1) a glass substrate, (2) a vacuum-deposited layer of aluminum, (3) a barrier layer consisting of a 0.15 micron thick layer of SiO, (4) a 10 micron thick layer of intrinsic $\alpha$-Si(H), and (5) a 0.03 micron thick layer of $\alpha$-Si(H) which had been doped with phosphorus by incorporating phosphine gas at a concentration of 100 ppm in the silane composition used to form the layer.

Using a positive surface potential and exposure to activating radiation at a wavelength of 400 nm, the quantum efficiency was determined in relation to the magnitude of the surface potential. (The quantum efficiency is defined as the ratio of the decrease in the surface charge density to the absorbed photon flux, assuming the charge density is related to the surface voltage by the geometrical capacitance). The results are shown in FIG. 1, which also provides the results for an otherwise identical control element which did not have the doped $\alpha$-Si(H) layer. In the figure, which is a logarithmic plot of quantum efficiency ($\phi$) versus electric field, the results for the test element of the invention are shown by open circles, while those for the control element are shown by solid circles. As shown in FIG. 1, the quantum efficiency of the control element decreased substantially with decreasing surface voltage, while the quantum efficiency of the test element was substantially independent of surface voltage over a wide range of voltages. With both the control and test elements, the quantum efficiency at high voltage was unity. As demonstrated by FIG. 1, the thin layer of doped $\alpha$-Si(H) is a critical component of the photoconductive insulating elements which are useful in the method of this invention, as this layer strongly reduces the field dependence of the photogeneration efficiency and thereby gives rise to the high sensitivity that is observed at low fields.

Figure 2:
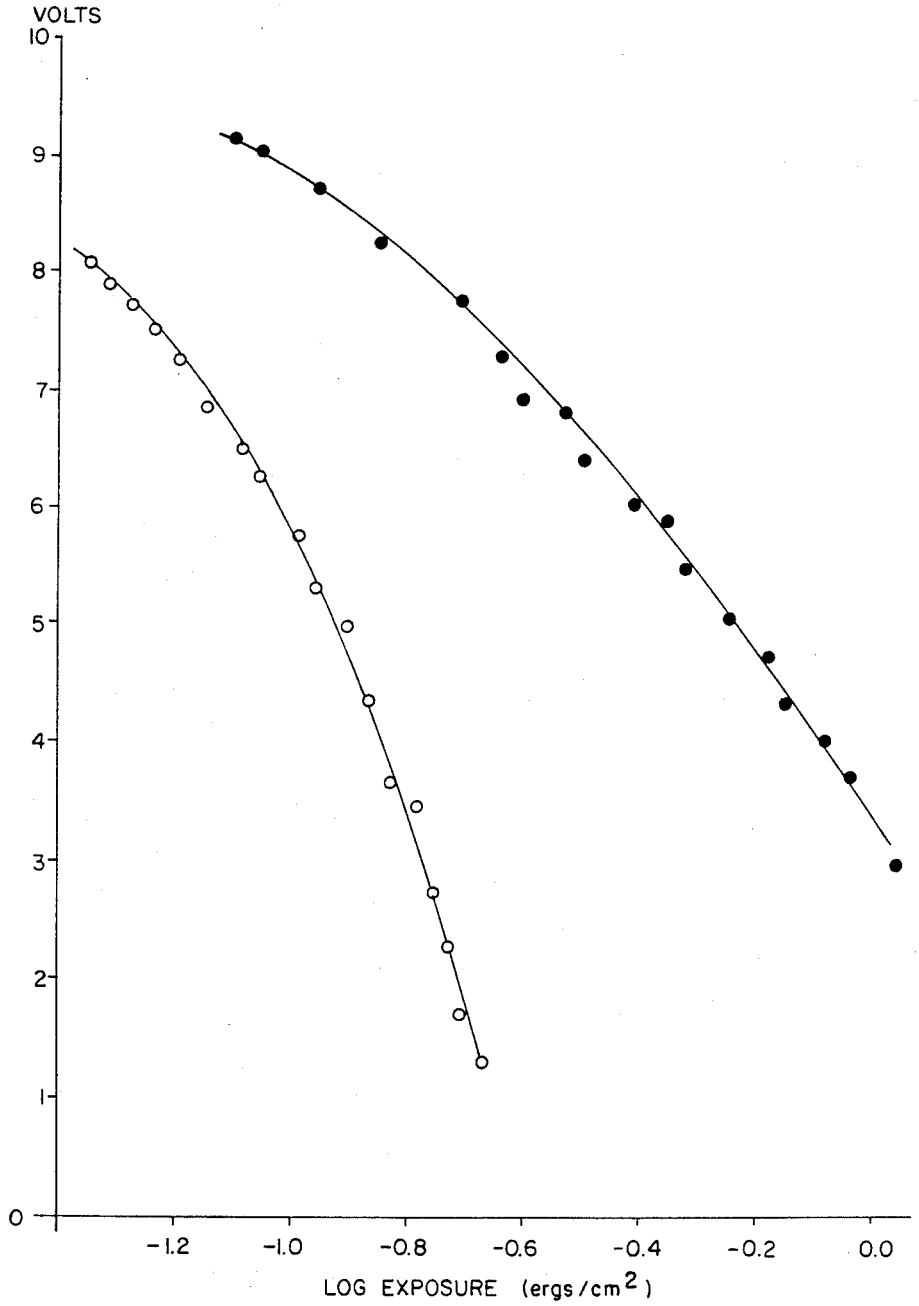
FIG. 2 is a V-logE plot for the test element and control element of FIG. 1.

The exposure dependence of the surface voltage for the control and test elements described above, with an initial potential of 10 volts, is shown in FIG. 2. In obtaining these data, the exposure wavelength was 400 nm, the exposure duration was 160 microseconds, and the voltage was sampled 0.5 seconds after the cessation of exposure. As shown by FIG. 2, the control element exhibited discharge from $V_o$ to $V_o/2$ with an exposure of 0.29 ergs/cm$^2$, corresponding to an ASA rating of about 12, while the test element required only 0.11 ergs/cm$^2$, corresponding to an ASA rating of about 30.

The invention has been described in detail with particular reference to preferred embodiments thereof, but it will be understood that variations and modifications can be effected within the spirit and scope of the invention.

I claim:

1. A method of electrophotographic imaging which comprises:

(1) providing a photoconductive insulating element comprising:
  (a) an electrically-conductive support,
  (b) a barrier layer overlying said support, and
  (c) a photoconductive stratum overlying said barrier layer, said stratum comprising a layer of intrinsic $\alpha$-Si(H) in electrical contact with a layer of doped $\alpha$-Si(H), saie doped $\alpha$-Si(H) layer being very thin in relation to the thickness of said intrinsic $\alpha$-Si(H) layer, (2) uniformly electrostatically charging said element to a surface voltage in the range of from 5 to 50 volts, and (3) image-wise exposing said doped $\alpha$-Si(H) layer to activating radiation to thereby form a latent electrostatic image on the surface of said element.

2. The method of claim 1 wherein said surface voltage is in the range of from 10 to 20 volts.

3. The method of claim 1 wherein said doped $\alpha$-Si(H) layer is doped with an element of Group III A or Group VA of the Periodic Table.

4. The method of claim 1 wherein said doped $\alpha$-Si(H) layer is doped with phosphorus.

5. The method of claim 4 wherein the phosphorus is present in said doped $\alpha$-Si(H) layer at a concentration of about 15 to about 150 ppm.

6. The method of claim 1 wherein the ratio of the thickness of said doped $\alpha$-Si(H) layer to the thickness of said intrinsic $\alpha$-Si(H) layer is less than 0.01.

7. The method of claim 1 wherein the ratio of the thickness of said doped $\alpha$-Si(H) layer to the thickness of said intrinsic $\alpha$-Si(H) layer is in the range of from 0.001 to 0.005.

8. The method of claim 1 wherein the hydrogen concentration in both said intrinsic $\alpha$-Si(H) layer and said doped $\alpha$-Si(H) layer is in the range of 5 to 25 percent.

9. The method of claim 1 wherein the thickness of said intrinsic $\alpha$-Si(H) layer is in the range of about 3 to about 30 microns.

10. The method of claim 1 wherein the thickness of said doped $\alpha$-Si(H) layer is in the range of about 0.02 to about 0.1 microns.

11. A method of electrophotographic imaging which comprises:

(1) providing a photoconductive insulating element comprising:
  (a) an electrically-conductive support,
  (b) a barrier layer overlying said support, and
  (c) a photoconductive stratum overlying said barrier layer, said stratum comprising a layer of intrinsic $\alpha$-Si(H) with a thickness of about 10 microns in electrical contact with a layer of phosphorus-doped $\alpha$-Si(H) with a thickness of about 0.03 microns.

(2) uniformly electrostatically charging said element to a surface voltage of about 10 volts, and (3) image-wise exposing said layer of phosphorus-doped $\alpha$-Si(H) to activating radiation to thereby form a latent electrostatic image on the surface of said element.

12. The method of claim 1 wherein said doped $\alpha$-Si(H) layer has been formed by a process of plasma-induced dissociation of a gaseous mixture of a silane and a doping agent in which the temperature has been controlled so that an initial major portion of said layer of doped $\alpha$-Si(H) was formed at a temperature in the range of from 200° C. to 400° C., and a final minor portion of said layer of doped $\alpha$-Si(H) was formed at a temperature in the range of from 125° C. to 175° C.

13. The method of claim 12 wherein about eighty percent of the thickness of said layer of doped $\alpha$-Si(H) was formed at a temperature of about 250° C. and the remainder was formed at a temperature of about 150° C.

* * * * *